US012807883B2

(12) United States Patent
Ferres Dellapiane et al.

(10) Patent No.: US 12,807,883 B2
(45) Date of Patent: Nov. 24, 2026

(54) PROCESSES FOR OBTAINING BIOFUELS

(71) Applicants: Juan Diego Pablo Ferres Dellapiane, São Paulo (BR); WASTECRAFT DESENVOLVIMENTO EXPERIMENTAL EM CIENCIAS FISICAS E NATURAIS LTDA, Rio de Janero (BR)

(72) Inventors: Juan Diego Pablo Ferres Dellapiane, São Paulo (BR); Donato Alexandre Gomes Aranda, Rio Janeiro (BR)

(73) Assignees: Juan Diego Pablo Ferres Dellapiane, São Paulo (BR); WASTECRAFT DESENVOLVIMENTO EXPERIMENTAL EM CIENCIAS FISICAS E NATURAIS LTDA, Rio de Janeiro (BR)

( * ) Notice: Subject to any disclaimer, the term of this patent is extended or adjusted under 35 U.S.C. 154(b) by 0 days.

(21) Appl. No.: 19/039,062

(22) Filed: Jan. 28, 2025

(65) Prior Publication Data

US 2025/0333655 A1 Oct. 30, 2025

(30) Foreign Application Priority Data

Feb. 6, 2024 (BR) ..... 1020240024540

(51) Int. Cl.
*C10G 3/00* (2006.01)

(52) U.S. Cl.
CPC ..... *C10G 3/40* (2013.01); *C10G 3/44* (2013.01); *C10G 2300/1014* (2013.01); *C10G 2300/1018* (2013.01)

(58) Field of Classification Search
CPC .... C10G 3/40; C10G 3/44; C10G 2300/1014; C10G 2300/1018
See application file for complete search history.

(56) References Cited

FOREIGN PATENT DOCUMENTS

WO WO-2010005391 A1 * 1/2010 ..... C11C 3/003

* cited by examiner

*Primary Examiner* — Taiwo Oladapo
(74) *Attorney, Agent, or Firm* — MUNCY, GEISSLER, OLDS & LOWE, P.C.

(57) ABSTRACT

Use of short-chain alcohols as fatty acid extracting solvents present in oils and fats, in a multistage system. At the end of the last stage there is a low acid ester, raffinate, and an extract, containing fatty acids and methanol, which return to the beginning of the enzymatic esterification, where they receive more fatty acids from the hydrolysis step. Thus, there is a full integration of all unit operations involved in this process.

4 Claims, 2 Drawing Sheets

PROCESSES FOR OBTAINING BIOFUELS

PRIOR RELATED APPLICATIONS

The present application claims priority to Brazilian Application BR 1020240024540, filed on Feb. 6, 2024. The entire content of prior application is incorporated by reference herein.

The present invention is located in the field of chemistry, specifically fuels, more specifically renewable fuels, such as biodiesels and biokerosenes, exactly a process that uses short-chain alcohols as fatty acid extracting solvents present in oils and fats, in a multi-stage system, synergistically integrated with liquid-liquid extraction (LLE).

The production of biodiesel is almost always carried out through transesterification reaction, with basic catalysts. It is the chemical reaction of a vegetable oil or animal fat with a short-chain alcohol (methanol or ethanol) in the presence of a catalyst. In fact, in the entire chemical industry, few processes have a yield that can be greater than 99% under mild conditions of temperature and atmospheric pressure. This is the case in most industrial biodiesel plants. However, for this to occur, there is an important condition: lipids must have very low acidity, which is common for most virgin vegetable oils such as soybean, canola, and sunflower oils, among others. However, there are many cases where the acidity is significantly higher than 1-2%, especially for some fats, used frying oils and palm oils, such as African palm or macauba. Oilseed raw materials account for almost 90% of the cost of producing biodiesel. Oils and fats of higher acidity are usually cheaper and the most common treatment is the "pre-esterification" of free fatty acids with methanol, in the presence of acid catalysts such as sulfuric acid, or para-toluene sulfonic acid, both of which are quite corrosive. In addition, these catalysts have a non-negligible cost and will consume part of the basic transesterification catalyst downstream. The additional costs of these catalysts may not be as bothersome as the inexorable presence of salts that are formed by the reaction between the acidic and basic catalysts. Such salts tend to accumulate in the plant causing serious heat exchange problems, fouling and loss of product quality. A more selective solution to these fatty acids would be most welcome for the reasons set out above. One option is chemical refining, but this only applies to the presence of free fatty acid contents below 2-3% since the soaps generated in this step tend to generate emulsions that absorb a significant amount of neutral oil, resulting in a significant yield loss. In addition, the amount of waste generated is growing, increasing the costs of this additional treatment. Physical refining, a vacuum distillation with steam drag, applies at higher acidity values. However, it has a high energy cost and the partial drag of the neutral oil limits its use.

An in-depth analysis of the current technology reveals a gap in processes for producing high-yield biofuels, as can be seen in patent GB1282926, "Esterification and extraction process", filed by El Paso Products Co. on Oct. 10, 1968, for a process for separating esterifiable aliphatic carboxylic acids mixed with other aliphatic carboxylic acids mixed in aqueous solutions, the mixture is placed in contact with an alkyl alcohol (1-5° C.), alkylene glycol or their ether derivatives at temperatures of 25 degrees B.P. in the presence of an esterification catalyst and simultaneously and countercurrently contacted with a water-immiscible organic solvent to extract the esters as formed, partitioning into an organic phase containing at least a portion of the esters and an aqueous phase containing excess water-miscible solvent, non-esterified organic acids and water, stratifying and separating the two phases, distilling the organic phase to recover the solvent and esters and distilling the aqueous phase to recover any excess water-miscible solvent and the residue. The aqueous solution can be mixtures of at least two monocarboxylic acids, saturated or unsaturated, substituted or unsubstituted, a dicarboxylic acid that is saturated or unsaturated, substituted or unsubstituted, and tri- or polycarboxylic acids and many are listed, for example, the mixed acids obtained by the nitric acid oxidation of cyclohexanol and cyclohexanone, and of fats and fatty acids; the oxidation of paraffins; the hydration of maleic acid; the fermentation processes that produce lactic, oxalic or citric acids; and carbohydrate degradation processes producing levulinic acid. The water-immiscible solvents may be aliphatic, cycloaliphatic and aromatic hydrocarbons and aliphatic or aromatic halogenated hydrocarbons. The process is illustrated using an apparatus comprising a series of three feed tanks, three extractors and two clarifiers to provide a continuous system. Examples describe the extraction of dimethyl esters of mixed succinic, glutaric and adipic acids from the oxidation of cyclohexanol and cyclohexanone nitric acid, and from the oxidation of cyclohexane nitric acid; esters of oleic oxidation acids and resin oil; mixed esters of maleic and cyanacetic acids, esters of mixed oxalic, malonic, succinic, glutaric and alipic acids, esters of mixed acids from the hydration of maleic acid; esters of technical quality aconitic, lactic and levulinic acids and acids derived from sucrose hydrolysis.

In addition, document CN102229865, "Method for preparing low-cold-filter-plugging-point biodiesel", from University Beijing Chemical, with a priority date of May 2011, describes a method for preparing biodiesel with a low cold filter plugging point, which comprises the following steps: preparation of free fatty acids by hydrolysis of the feedstock grease; separation of free fatty acids by a urea clathrate process to obtain a fraction containing rich saturated fatty acids and a fraction containing rich unsaturated fatty acids; and carry out the esterification reaction of the fraction containing rich saturated fatty acids, which are obtained by the step, with short-chain alkanols and the esterification reaction of the fraction containing rich unsaturated fatty acids, which are obtained by the step, with methanol, mixing the two parts of fatty acid esters obtained by the reactions uniformly and obtaining biodiesel with better low-temperature flow properties. The method for improving the low temperature flow property of short chain alkanol biodiesel is simple to operate, is highly adaptable to feedstock oils and can achieve a high utilization rate; and the physical and chemical properties of the product prepared by the method meet the values specified in the standards for biodiesel.

Finally, protection JP2000143587, "Production of aliphatic ester compound", filed by Ube Industries on Nov. 10, 1998, describes an adipic diester is obtained by hydroesterification of an olefin derivative, pref. an α-olefin monoester such as methyl 4-pentanoate in the presence of carbon monoxide and alcohol such as methanol in an acidic atmosphere using a metal carbonyl cluster as a pref. catalyst under the pressure of component B at 40-6,050 kg/cm$^2$ pref. at 130-160 degrees C. for 8-9 h; wherein it is preferred that the above catalyst be such that a rhodium carbonyl cluster catalyst of the formula: Rh4(CO)12 or the like is carried on a zeolite solid acid, such as H-zeolite (A3).

In view of the gaps in the technique, the proposed invention is the use of short-chain alcohols (methanol, ethanol) as fatty acid extracting solvents present in oils and fats, in a multistage system. At the end of the last stage there is a low acid ester, raffinate, and an extract, containing fatty acids and methanol or any short-chain alcohols, which return to the beginning of the enzymatic esterification, where they receive more fatty acids from the hydrolysis step. Thus, there is a full integration of all unit operations involved in this process.

Instead of using tools to remove the fatty acids naturally present in crude oils, one can, through enzymatic or hydrothermal hydrolysis reactions (or combination of both) transform all triglycerides, diglycerides and monoglycerides into fatty acids and glycerin. These fatty acids can be used as such in various applications in the oleochemical industry but can also be transformed into hydrocarbons by the HEFA route. Alternatively, they can be transformed into methyl or ethyl esters and one of the most effective and clean ways to do this is through enzymatic esterification, chemical and reactive distillation. It turns out that, typically, at the end of esterification, there is still the presence of free fatty acids at levels above that allowed in the biodiesel specifications. These fatty acids can be removed by extraction. The use of solvents for liquid-liquid extraction (LLL) is a possible option. LLE, also known as partitioning, is a separation process consisting of the transfer of a solute from one solvent to another, the two solvents being immiscible or partially miscible with each other. As in all extraction processes, the liquid-liquid extraction comprises a mixing (contact) step, followed by a phase separation step. It is important to consider both steps when selecting solvents and modes of operation. Thus, although vigorous mixing is favorable to the transfer of the extractable from one solvent to the other, it can also impair the ease of phase separation by the formation of emulsions. Given a solvent, the residual liquid solution from which the solute is drawn is called a raffinate and the product-rich solvent is called an extract. In the specific case, the solvent should be as selective as possible for the solubilization of free fatty acids and not triglycerides. Hexane, for example, is an excellent solvent for lipids, but does not exhibit the desired selectivity. The present invention proposes the use of short-chain alcohols (methanol or ethanol) as extracting solvents for fatty acids present in oils and fats, in a multi-stage system. At the end of the last stage we have a low acid ester, raffinate, ready to be stored in tanks and shipped to the distributors. The extract, containing fatty acids and methanol, returns to the beginning of the enzymatic esterification, where it will receive more fatty acids from the hydrolysis step. Thus, there is a full integration of all unit operations involved in this process, bringing the benefits of reducing the consumption of catalysts and avoiding fouling and loss of product quality.

The synergistic processes for high yield of obtaining biofuels can be synthesized as follows: its main steps: hydrolysis—enzymatic, hydrothermal or combination of both—of vegetable oils or animal fats generating glycerin and fatty acids; esterification of fatty acids; removal of remaining fatty acids by liquid-liquid extraction process.

Alternatively, hydrolysis occurs in a continuous countercurrent column process, in the oil: water mass ratio is 1:0.8 to 1:1.2, reaction temperature between 24° and 270° C., operating pressure between 40 and 60 bar and spatial time between 0.5 and 2 hours.

Alternatively, hydrolysis occurs in batch process in the presence of lipases, at a temperature of 35 to 50° C. and pressure of 1 to 2 bar.

Alternatively, esterification occurs with methanol or ethanol or propanol or butanol or a mixture of these alcohols, catalyzed by lipase-type enzymes or enzymatic broths obtained from plant extracts or catalyzed by sulfuric acid or para-toluene sulfonic acid or methanesulfonic acid, the catalyst concentration relative to fatty acid being 0.5% to 3%, the reaction temperature in the range of 120 to 180° C., the reaction pressure in the range of 1 to 25 bar, the alcohol: fatty acid molar ratio ranging from 1 to 10, and the reaction temperature is in the range of 40 to 60° C. and atmospheric pressure.

Alternatively, the extraction of fatty acids present in vegetable oils, fats and esters uses alcohols in multiple stages, generating a raffinate and an extract that are integrated into the biodiesel production unit, the alcohols being methanol, ethanol, propanol, butanol or a mixture of them; the process takes place at a temperature of 20 to 60° C., in 2 to 10 stages in series, from 1 to 5 bar in which the raffinate is taken to the biodiesel production unit and its intermediates, subjected to alcoholic neutralization, followed by transesterification with the production of alkyl esters, followed by washing, drying and filtering of the final biodiesel, the extract being taken to the esterification or glycerolysis unit for the production of biodiesel and its intermediates and the alcohol/oil mass ratio is 0.5:1 to 1.5:1, respectively.

The invention can be better understood by means of FIG. 1, which illustrates the step of liquid-liquid extraction (LLE) of fatty acids with alcohols: multistage liquid-liquid extraction scheme.

EXAMPLES

Example 1—Animal fat with 5.5% free fatty acids, phosphorus content of 19 ppm and humidity of 0.3%, submitted to an extraction system with seven stages, at a temperature of 40° C. and fed 800 kg/h of methanol for each ton of animal fat generates as a result a raffinate of 2.2% acidity and an extract with 25% acidity with a spatial time of 90 minutes.

Example 2—Animal fat with 5.5% free fatty acids is subjected to hydrolysis with lipases at 450° C. for 8 hours, obtaining conversion of 72% to fatty acids. After separation of the aqueous phase containing glycerin, from the oil phase containing fatty acids, triglycerides, diglycerides and monoglycerides, this lipid phase is subjected to countercurrent tower hydrolytic scission in a 1:1 mass ratio (water:lipid fraction) at 255° C. and 55 bar pressure. In the upper stream of the column, 99.2% of free fatty acids are obtained, while at the base of the column the aqueous solution containing glycerin is obtained. The obtained fatty acids were then subjected to esterification by reactive distillation on a 12-course column with methanol countercurrent feed. At the top of the column, a methanol/water mixture is obtained, which is sent to recover the methanol in an appropriate column. At the bottom of the column, methyl ester with 2.3% fatty acids is obtained. Animal fat methyl ester with 2.3% free fatty acids, phosphorus content of 21 ppm and humidity of 0.8%, submitted to an extraction system with seven stages, at a temperature of 450° C. and fed with 850 kg/h of methanol for each ton of animal fat, results in a raffinate methyl ester compound with 0.2% acidity, being specified as biodiesel and an extract with 18% acidity with a spatial time of 70 minute.

The invention may be better understood with the aid of the figures.

Figure 1:
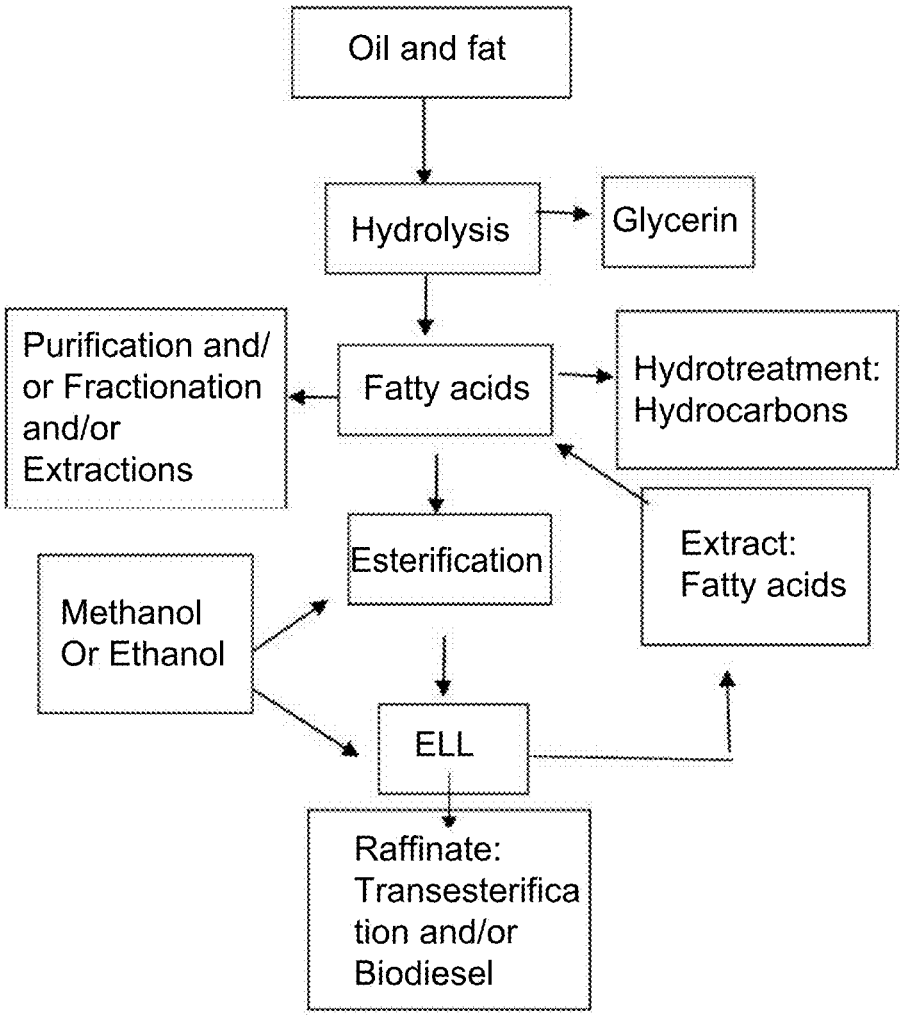
FIG. 1 is a flowchart of the synergistic integration of high throughput processes.
Figure 2:
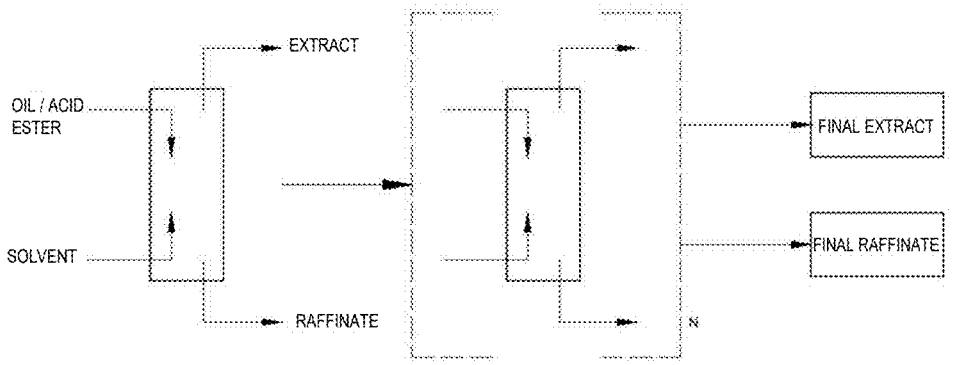
FIG. 2 is a flowchart of the liquid-liquid extraction sub-process.

In summary, the new process brings the benefits of reducing catalyst consumption and avoids fouling and loss of product quality.

This innovation is not limited to the representations commented or illustrated herein, and should be understood in its broad scope. Many modifications and other representations of the invention will come to the mind of one skilled in the art to which this invention belongs, having the benefit of the teaching presented in the previous descriptions and attached drawings. Furthermore, it is to be understood that the invention is not limited to the specific form disclosed, and that modifications and other forms are understood to be included within the scope of the appended claims. Although specific terms are employed herein, they are used only in a generic and descriptive manner and not for the purpose of limitation.

The invention claimed is:

1. A process for obtaining biofuels, comprising:

(a) hydrolyzing vegetable oils and/or animal fats to generate fatty acids and glycerol;

(b) esterifying the fatty acids with alcohol in the presence of a catalyst, wherein the alcohol is methanol, ethanol, propanol, butanol, or a mixture thereof;

(c) removing residual free fatty acids after the esterification step (b) by performing a multistage liquid-liquid extraction (LLE) using the alcohol of the esterification step (b), thereby yielding a raffinate comprising esters, an extract comprising fatty acids, and the alcohol;

(d) recycling the extract from the removing step (c) back to the esterification step (b) to form an integrated closed-loop process, wherein the recycled extract supplies additional fatty acids for esterification and reduces overall impurities in the process, wherein the hydrolyzing step (a) is carried out by a hydrothermal process performed in a continuous countercurrent hydrolysis column at a temperature of 240° C. to 270° C., a pressure of 40 bar to 60 bar, an oil-to-water mass ratio of 1:0.8 to 1:1.2, and a spatial time of 0.5 hour to 2 hours.

2. The process of claim 1, wherein the esterification step (b) is catalyzed by lipase-type enzymes, sulfuric acid, para-toluene sulfonic acid or methanesulfonic acid, wherein the esterification step (b) is carried out at an alcohol to fatty acid molar ratio of 1:1 to 10:1, at a temperature of about 120° C. to 180° C., at a pressure of 1 bar to 25 bar.

3. The process of claim 1, wherein the multistage liquid-liquid extraction is performed at a temperature of 20° C. to 60° C., in 2 to 10 stages, under a pressure of 1 bar to 5 bar, and an alcohol to fatty acid mass ratio is 0.5:1 to 1.5:1.

4. The process of claim 1, further comprising feeding the raffinate from the removing step (c) to a biodiesel distillation unit, or diverting the fatty acids obtained from the removing step (c) to a Hydroprocessed Esters and Fatty Acids (HEFA) unit for the production of Hydrotreated Vegetable Oil (HVO) or Sustainable Aviation Fuel (SAF).

* * * * *